United States Patent [19]

Goncalves

[11] Patent Number: 4,568,004

[45] Date of Patent: Feb. 4, 1986

[54] CONTAINER ALLOWING DROP BY DROP DISPENSING OF A DOSE OF A FLUID SUBSTANCE

[75] Inventor: Antonin L. Goncalves, Groslay, France

[73] Assignee: L'Oreal, Paris, France

[21] Appl. No.: 563,634

[22] Filed: Dec. 20, 1983

[30] Foreign Application Priority Data

Jan. 13, 1983 [FR] France ..... 83 00434

[51] Int. Cl.[4] ..... B65D 47/18

[52] U.S. Cl. ..... 222/207; 222/212; 222/422; 222/520

[58] Field of Search ..... 222/207, 212, 422, 519, 222/520, 525, 529

[56] References Cited

U.S. PATENT DOCUMENTS

| | | | |
|---|---|---|---|
| 996,330 | 6/1911 | Haines | 222/207 |
| 1,977,537 | 10/1934 | Warmuth | 222/520 |
| 2,582,026 | 1/1952 | Friedman | 222/520 X |
| 3,326,402 | 6/1967 | Randazzo | 222/520 |
| 3,552,605 | 1/1971 | Hein | 222/207 |

FOREIGN PATENT DOCUMENTS

| | | | |
|---|---|---|---|
| 542439 | 11/1955 | Belgium | 222/519 |
| 180009 | 5/1922 | United Kingdom | 222/520 |

*Primary Examiner*—Joseph J. Rolla
*Assistant Examiner*—Frederick R. Handren
*Attorney, Agent, or Firm*—Cushman, Darby & Cushman

[57] ABSTRACT

A container for drop-by-drop dispensing of a fluid substance comprises a bottle having a detachable stopper mounted movably on the neck of the bottle so that, in a stoppering position, discharge ports of the stopper are closed off by the neck of the bottle and in a remote position the discharge ports are open. A flexible discharge end fitting which may be squeezed to actuate dispensing of the fluid substance is a snap fit on the relatively harder stopper. The discharge end fitting is limited in its travel towards the remote position along the neck so that the two part stopper/discharge fitting unit is captive on the neck.

10 Claims, 4 Drawing Figures

CONTAINER ALLOWING DROP BY DROP DISPENSING OF A DOSE OF A FLUID SUBSTANCE

FIELD OF THE INVENTION

The present invention concerns a bottle allowing a dose of a fluid substance to be dispensed which is intended to be applied drop by drop, for instance, for the dispensing of hair treatment products which the hairdresser has to spread over the scalp.

BACKGROUND OF THE INVENTION

For this purpose, one generally uses glass ampoules which are to be filed off or are frangible and, at the time of use, have an applicator end fitting made of a soft material attached to them. The frangible ampoules generally used have the drawback that their readiness to break remains limited; it may happen that glass fragments drop into the ampoule, which is to be avoided at all costs, especially when the contents of the ampoule are intended to be applied to the scalp. The so-called filing off capsules are even more difficult to handle and their readiness to break is also quite limited.

Moreover, the packaging of these ampoules in the factory requires very specialised equipment.

Furthermore, as has been indicated above, it is necessary at the time of use, to fit on to the ampoule an applicator end fitting made of a soft plastic material which must, on the one hand, avoid all risk of contact between the skin of the scalp and the ampoule which has been previously either broken or filed off, as the case may be, and, on the other hand, allow a drop by drop application by successive pressures on the said end fitting.

Finally, the glass ampoules constitute packaging units of a high final cost for a very limited ease of use.

SUMMARY OF THE INVENTION

The object of the present invention is to propose a bottle intended as a cheap replacement for the currently used frangible glass ampoules or those to be filed off, these bottles procuring, moreover, a greater ease of use.

The bottle according to the present invention is provided with a device serving both for the leakproof stoppering and the application of the quantity of the substance contained in the bottle, this device being directly fixed to the bottle. The unit is, moreover, advantageously made of a plastic material. Thus the bottle according to the invention constitutes a low cost packaging unit convenient in use, without any risk of injury when it contains a treatment product to be applied to the scalp.

Moreover, this bottle with its associated stoppering and applicator device has an outer appearance comparable to that of a glass ampoule; the "pharmaceutical" nature of the glass ampoules traditionally used is thus retained which represents an important factor from the commercial standpoint.

Accordingly the present invention provides a new industrial product constituted by a container intended to enclose a dose of a fluid substance capable of being applied drop by drop by successive pressures on a flexible dispenser end fitting, fitted on the discharge opening of the said container, characterised in that the container comprises a bottle, on the neck whereof, there is fitted a detachable stoppering cap constituted by a skirt connected to a top intended to bear, in the stoppering position, on the edge of the said neck, the said top comprising at least one port disposed opposite the edge of the said neck; in that the dispenser fitting comprises in its lower portion a sleeve whereby it tightly fits around the skirt of the said stoppering cap so that the said cap and the said end fitting are subject to joint displacements, and in that means are provided for rendering said dispenser fitting capable of detachment from the bottle, the substance being capable of being dispensed by discharging through the said at least one port of the stoppering cap when the top of the cap does not bear on the bottle neck.

In accordance with a preferred mode of embodiment of the present invention, the stoppering cap is a threaded cap, its skirt thus being a cylindrical skirt carrying an inner thread intended to cooperate with an external thread of the bottle neck.

In accordance with a preferred mode of embodiment of the cap, the top of the cap comprises regularly distributed ports at the periphery of the said top, the central zone of the top carrying a stopper intended to obturate the bottle neck when the said top bears on the edge of the neck. Preferably, the stopper consists of a cylindrical protuberance penetrating with a tight fit into the discharge opening of the bottle, the free edge of the said protuberance being chamfered to allow the stoppering cap to be easily fitted on the neck of the bottle.

The means for limiting the withdrawal motion of the stoppering cap may consist of a peripheral collar of the external wall of the bottle neck and an inner flange of the lower sleeve edge of the dispenser end fitting, the peripheral collar constituting a stop for the said flange. Preferably, the distance separating the sleeve flange and the peripheral collar of the neck is, in the stoppering position, shorter than the distance which the stoppering cap must travel to pass from the stoppering position of the bottle as far as the position wherein the skirt of the said stoppering cap is detached from the bottle neck.

According to a particular mode of embodiment of the container according to the invention, the peripheral collar provided on the bottle neck has, on the one hand, on the side nearer the free edge of the neck, an external conical surface widening towards the barrel of the bottle and joined to the external wall of the neck and, on the other hand, on the side nearer the barrel of the bottle, a side substantially perpendicular to the external wall of the neck, the sleeve flange of the dispenser end fitting having, on the side of the free edge of the neck, an internal side substantially perpendicular to that of the said sleeve.

Moreover, in the stoppering position, the dispenser end fitting comes to bear substantially on the barrel of the bottle. In the case where the barrel of the bottle is joined to its neck by a conical wall widening towards the said barrel, the sleeve flange has, on the side of the barrel of the bottle, a conical wall which is complementary to that of the bottle.

The dispenser end fitting has, advantageously, a reservoir compartment joining the upper portion of the sleeve and extending on the opposite side of the latter in a discharge duct. Preferably, the reservoir compartment has a cylindrical inner surface and an ovoid external surface, the wall of the said reservoir compartment having a thickness which is progressively increasing from the connecting point of the said reservoir compartment with the sleeve, then progressively decreasing towards the discharge duct.

Moreover, the internal wall of the sleeve has, advantageously, at the upper portion of the sleeve, an annular bearing surface in permanent contact with the upper edge of the skirt of the stoppering cap.

In accordance with a particular mode of embodiment of the bottle according to the invention, the barrel of the said bottle is made of polyvinyl chloride and the stoppering cap and the dispenser end fitting associated therewith are respectively of polypropylene and of soft polyethylene.

BRIEF DESCRIPTION OF THE DRAWINGS

There will be described below in greater detail, a mode of embodiment of the bottle according to the present invention, with reference to the attached drawings by way of a purely indicative and non-restrictive example.

In these drawings.

DESCRIPTION OF THE PREFERRED EMBODIMENT

Figure 1:
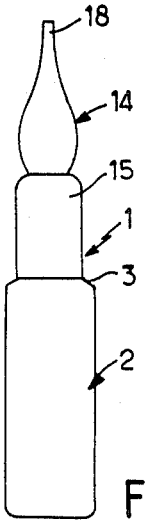
FIG. 1 represents a view in elevation of the container according to the invention fitted with its applicator end fitting in the stoppering position.

Referring to FIG. 1, it will be seen that 1 designates a bottle as whole which is intended to contain a quantity of a hair treatment product and whereon there is fitted a sealing device, and then means for application of the substance contained in the bottle. The unit has an appearance similar to that of a glass ampoule which is the conventional packaging mode for this type of product.

Figure 2:
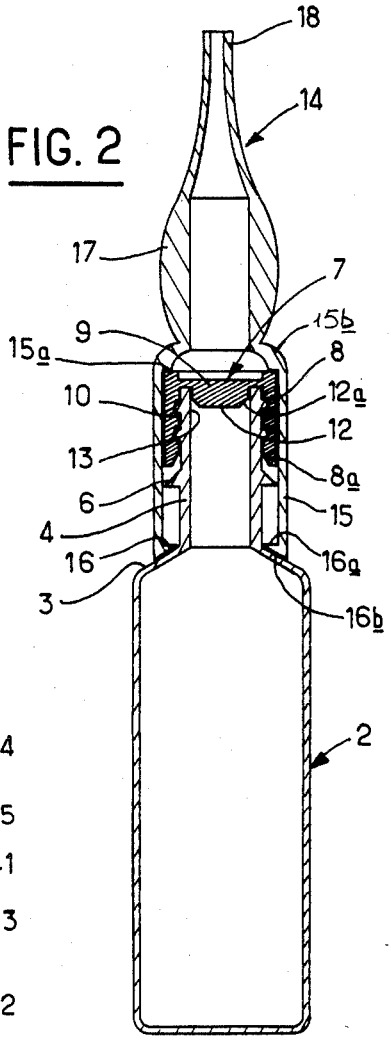
FIG. 2 is a cross sectional view on an enlarged scale, of the bottle shown in FIG. 1.
Figure 3:
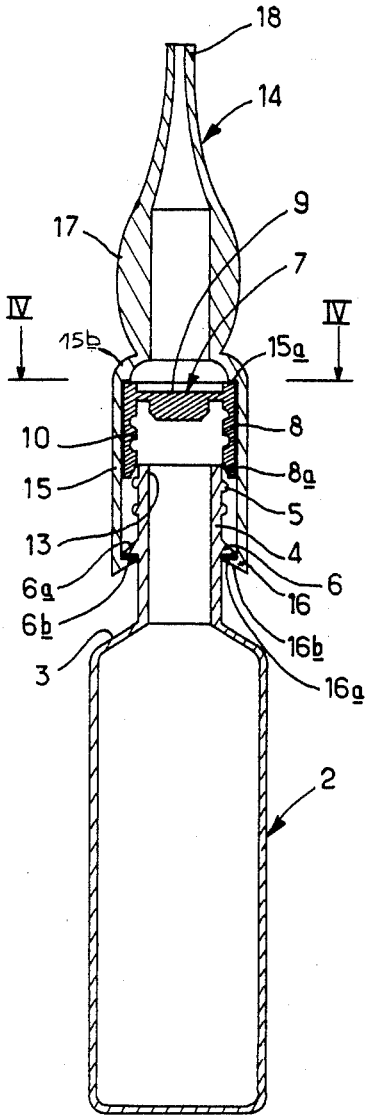
FIG. 3 is a view corresponding to FIG. 2 in the position for dispensing the dose of the substance contained in the container bottle.

FIGS. 2 and 3 show this bottle in detail. The bottle 2 proper has an elongated cylindrical barrel of polyvinyl chloride joined via a conical shoulder 3 to a neck 4. This latter has externally, near its upper edge, a thread 5 and below the said thread 5, but at a certain distance from the connecting zone of thread 4 with shoulder 3, a peripheral collar 6. This collar 6 has a conical external surface 6*a* divergent towards the barrel of bottle 2 and joined in its upper portion directly to the external wall of neck 4 and in its lower portion along a side 6*b* perpendicular to the external wall of neck 4.

A stoppering cap 7 of polypropylene is capable of being fitted on neck 4 of bottle 2. It is constituted by a cylindrical skirt 8 joined near one of its ends to a flat top 9.

Skirt 8, whose internal edge 8*a* is chamfered to facilitate the positioning of cap 7 on neck 4 carries internally a thread 10 intended to come to cooperate with thread 5 of neck 4.

Figure 4:
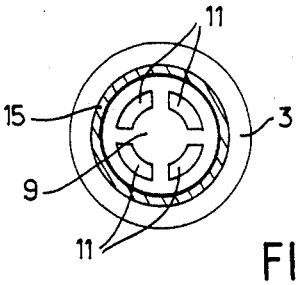
FIG. 4 is a cross section along IV—IV of FIG. 3.

Top 9 has, at its periphery, four regularly disposed openings 11 and each having the shape of a sector of an annulus, as may be seen in FIG. 4.

In the stoppering position of cap 7, these openings 11 come to be situated on the upper edge of neck 4. Moreover, top 9 carries internally a cylindrical stopper 12 intended to be force fitted in the discharge opening 13 of bottle 2 to ensure the leakproof stoppering of the bottle. The lower edge 12*a* of stopper 12 is chamfered so as to facilitate its introduction into the discharge opening 13.

On the unit constituted by bottle 2 and its stoppering cap 7, there is mounted a dispenser end fitting 14 made of soft polyethylene. End fitting 14 consists of a hollow body comprising from the bottom to the top, a cylindrical sleeve 15 having a lower inner flange 16, a reservoir compartment 17 and an elongated discharge duct 18.

End fitting 14 is fitted on neck 4 obturated by cap 7, by its sleeve 15, the sleeve being in close and constant contact with skirt 8 of cap 7 by virtue of its elasticity. Moreover, the inner flange 16 of sleeve 15 comes, in the locked position of end fitting 14, to bear on the conical shoulder 3 joining the barrel of bottle 2 to its neck 4. For this purpose, flange 16 has a conical axially outer wall 16*b* flaring towards the barrel of bottle 2. Moreover, the internal wall 16*a* of flange 16 is perpendicular to the cylindrical wall of sleeve 15, flange 16 being capable, during the translation towards the top of end fitting 14 and of cap 7, of coming to bear against wall 6*b* of collar 6. In its upper portion, the cylindrical wall of sleeve 15 has a greater thickness so as to form internally an annular bearing surface 15*a* which is in permanent contact with the upper edge of skirt 8 projecting from top 9. Immediately above this annular bearing surface 15*a*, sleeve 15 joins, along the dome-shaped portion 15*b*, the reservoir compartment 17. This latter has an internal cylindrical surface disposed in the extension of the discharge opening 13 of bottle 2 and an external ovoid surface, the reservoir compartment 17 having a progressively increasing thickness from the connection zone between the upper dome-shaped portion 15*b* of sleeve 15 and then a progressively decreasing one, so as to extend along the elongated discharge duct 18.

In accordance with a characteristic of the invention, the distance separating flange 16 of the sleeve 15 and the peripheral collar 6 of neck 4 is, in the closed position of end fitting 4, substantially equal to the distance which the end fitting 14 must travel upwards so that cap 7 should just be in contact by the lower internal edge of its skirt 8 with the neck 4 of bottle 2.

The assembly and packaging of the bottle according to the invention is effected in the factory as follows:

One starts by filling, as usual, a series of bottles 2 with the required product and then their stoppering is effected automatically by the snap insertion of caps 7, ports 11 coming to be situated on the upper edge of necks 4 of bottles 2, the chamfered edges 8*a* and 12*a* of skirt 8 and of stopper 12, respectively, facilitating this operation. The leakproof stoppering of bottle 2 is thus obtained. Then, one comes to place, on bottle 2, its soft applicator end fitting 14, flange 16 bearing with its external surface 16*b* on the conical shoulder 3 of bottle 2 and the annular bearing surface 15*a* being in contact with the upper edge of skirt 8 of cap 7. End fitting 14 performs the function of a protective hood in this stoppered position of bottle 2. Cap 7 and end fitting 14 are now fixed to each other ready for use and they thus constitute the stoppering and applicator device integrated with the bottle which forms the originality of the present invention.

When the user wishes to dispense the dose of the product, he unscrews the unit constituted by cap 7 and end fitting 14, the unscrewing motion effecting uncovering of the discharge opening 13 of bottle 2, the liquid contained in bottle 2 being capable of flowing freely via ports 11 which are arranged in the top 9 of cap 7. The withdrawal of cap 7 with its dispenser end fitting 14 is limited by the fact that flange 16 of sleeve 15 of the end fitting comes to bear against collar 6. In this position, cap 7 is not yet completely detached from bottle 2. It then suffices to cause the product to emerge drop by drop via the discharge duct 18, by successive squeezing pressures on end fitting 14. Cap 7 is always in the same position with respect to the dispenser end fitting 14, the upper edge of its skirt 8 being in contact with the annular bearing surface 15*a*.

It shall be duly understood that the mode of embodiment described above is in no way restrictive and may give rise to any desirable modification, without thereby departing from the scope of the invention.

I claim:

1. A container intended to contain a dose of a fluid substance, capable of being applied manually, drop by drop, said container comprising:

(a) a bottle having a barrel and a threaded neck, said neck including an end edge and a discharge opening therewithin;

(b) detachable stopper means for said discharge opening, said detachable stopper means including an integral skirt and an end wall joined thereto, said end wall having a portion bearing, in a stoppering position, on said end edge of said neck, said skirt having an internal threaded portion for cooperation with said threaded neck;

(c) said detachable stopper means including discharge port means in said end wall, said port means being disposed opposite said end edge of said neck; said discharge port means including means defining a plurality of ports regularly distributed about the periphery of said end wall of said detachable stopper means, said end wall further including a stopper which is surrounded by said ports and which is inserted into said neck of said bottle;

(d) a dispenser end fitting comprising a sleeve adapted to be fitted tightly around said skirt of said detachable stopper means so that upon movement of said dispenser end fitting relative to said bottle, said detachable stopper means will move with said dispenser end fitting, and (e) means for limiting axial movement of said dispenser end fitting along said neck to prevent said fitting from being detached from said bottle, said means for limiting said axial movement of said dispenser end fitting including a peripheral collar located on said neck of said bottle, externally thereof, and an internal flange on said sleeve of said dispenser end fitting with said peripheral collar being engageable by said internal flange of said sleeve upon a predetermined axial movement of said dispenser end fitting relative to said neck of said bottle.

2. A container according to claim 1, wherein said detachable stopper means comprises a cylindrical protuberance penetrating with a tight fit into the neck of the bottle, and wherein said protuberance includes a chamfered end remote from said end wall of the stopper means.

3. A container according to claim 1, wherein, in said stoppering position of the detachable stopper means, the distance separating said flange of the sleeve from said peripheral collar of the neck is shorter than a distance which said detachable stopper means must travel to pass from said stoppering position to a remote position where said skirt of said detachable stopper means is separated from the neck of the bottle.

4. A container according to claim 1, wherein said peripheral collar has first and second opposite sides of which said first side is nearer the end edge of the bottle neck, a conical surface on said first side divergent towards the barrel of the bottle and connected to the exterior of said neck and a surface on said second side substantially perpendicular to the exterior of said neck; and wherein said flange of the sleeve of the dispenser end fitting has first and second sides with said first side nearer the end edge of said neck, and at said first side, an inner surface substantially perpendicular to the interior of the said sleeve.

5. A container according to claim 1, wherein in said stoppering position, the dispenser end fitting substantially abuts the barrel of the bottle.

6. A container according to claim 4, wherein, in said stoppering position, the dispenser end fitting substantially abuts the barrel of the bottle; wherein the barrel of the bottle includes a conical wall portion which is divergent towards the said barrel and joins the barrel to the neck; and wherein the flange of the sleeve has on said second side thereof a conical wall surface complementary to said conical wall portion of the bottle.

7. A container according to claim 1, wherein the dispenser end fitting comprises means defining a reservoir compartment having first and second ends of which said first end adjoins said sleeve, and means defining a discharge duct and extending from the second end of said sleeve.

8. A container according to claim 7, wherein said reservoir compartment is bounded by a wall having an internal cylindrical surface and an ovoid external surface, and the wall has a thickness which progressively increases from said first end and then progressively decreasing towards said second end.

9. A container according to claim 1, wherein said end wall of said skirt of the detachable stopper means has first and second ends with said first end nearer to said barrel of the bottle, and wherein said sleeve includes an internal wall surface which has an annular bearing surface in permanent contact with said second end of said skirt.

10. A container according to claim 1, wherein the bottle is made of polyvinyl chloride, the detachable stopper means is of polypropylene, and the dispenser end fitting is of soft polyethylene.

* * * * *